United States Patent [19]

Crossin

[11] Patent Number: 4,751,008

[45] Date of Patent: Jun. 14, 1988

[54] STABLE SOIL RELEASE PROMOTING LIQUID DETERGENT CONTAINING FABRIC SOFTENER AND ENZYMES

[75] Inventor: Michael C. Crossin, Kendall Park, N.J.

[73] Assignee: Colgate-Palmolive Company, New York, N.Y.

[21] Appl. No.: 821,574

[22] Filed: Jan. 21, 1986

Related U.S. Application Data

[63] Continuation of Ser. No. 539,079, Oct. 5, 1983, abandoned, which is a continuation-in-part of Ser. No. 481,904, Apr. 4, 1983, abandoned.

[51] Int. Cl.[4] ..... C11D 3/37; C11D 17/08; D06M 13/46; D06M 15/513

[52] U.S. Cl. ..... 252/8.8; 252/8.9; 252/15.3; 252/173; 252/174.12; 252/174.21; 252/174.23; 252/547; 252/DIG. 12; 252/DIG. 14; 427/393.4

[58] Field of Search ..... 252/8.75, 8.8, 8.9, 252/153, 173, 174.12, 174.21, 174.23, 547, DIG. 12, DIG. 14; 427/393.4

[56] References Cited

U.S. PATENT DOCUMENTS

| | | | |
|---|---|---|---|
| 3,928,213 | 12/1975 | Temple | 252/8.8 |
| 3,959,230 | 5/1976 | Hays | 252/8.9 |
| 4,132,680 | 1/1979 | Nicol | 252/547 |
| 4,187,184 | 2/1980 | Becker | 252/8.8 |
| 4,318,818 | 3/1982 | Letton | 252/174.12 |

OTHER PUBLICATIONS

Technical Data on *Quaker QCF*, 2 pages, published by Quaker Chemical Corp., Conshohocken, Pa. (Division of Alkaril Chemical Co.).

*Primary Examiner*—Dennis Albrecht
*Attorney, Agent, or Firm*—Norman Blumenkopf; H. S. Sylvester; M. M. Grill

[57] ABSTRACT

A stable fabric softening, soil release promoting, enzyme-containing nonionic liquid detergent, preferably transparent or translucent, comprises a detersive proportion of a synthetic organic nonionic detergent, a soil release promoting proportion of a particular type of soil release promoting copolymer of polyethylene terephthalate and polyoxyethylene terephthalate, a softening proportion of a quaternary ammonium halide fabric softener, a proportion of enzyme sufficient to enzymatically hydrolyze proteinaceous and/or amylaceous soils on fabrics during washing thereof with an aqueous washing solution of the liquid detergent, a stabilizing proportion of a stabilizer for the enzyme(s), and an aqueous medium. The pH is in a certain range and the proportion of ionizable material present is limited. The described liquid detergent can be clear in appearance and is non-separating and of improved stability on storage (especially important with respect to enzymatic stability and effectiveness), with substantial retention of soil release promoting and hydrolyzing characteristics, so that laundry containing polyester materials is effectively cleaned and readily releases soil from it upon washing with the liquid detergent.

2 Claims, No Drawings

STABLE SOIL RELEASE PROMOTING LIQUID DETERGENT CONTAINING FABRIC SOFTENER AND ENZYMES

This application is a continuation of my patent application Ser. No. 539,079, filed Oct. 5, 1983, which now stands abandoned which was a continuation-in-part of my application Ser. No. 481,904, filed Apr. 4, 1983 now abandoned. The specification of Ser. No. 481,904 is incorporated in this specification by reference. Ser. No. 628,967, now abandoned, is a continuation of Ser. No. 481,904.

This invention relates to stable liquid detergent compositions. More particularly, it relates to such compositions which contain a soil release promoting polymer which deposits on polyester and polyester blend materials during washing thereof and promotes the release from them of subsequently applied lipophilic soils. Such compositions also contain fabric softener(s) and enzyme(s) for their known properties, and, surprisingly, the compositions are physically and functionally stable upon storage despite the fact that other compositions containing some such components are unstable, and that such instability was to be expected.

Liquid detergents have been employed for the washing of household laundry items in washing machines, and various such detergents have contained fabric softeners and enzymes. The employment of copolymers of polyethylene terephthalate and polyoxyethylene terephthalate in detergent compositions as soil release promoting agents has been described in various patents, among which may be mentioned British Pat. Nos. 1,154,370 and 1,377,092, and U.S. Pat. Nos. 3,962,152, 4,125,370 and 4,132,680. Liquid detergents containing the mentioned type of soil release promoting polymer are described in U.S. Pat. Nos. 4,125,370 and 4,132,680. In both such patents, however, the liquid detergents described are not of the type of the present invention because those of the patents contain triethanolamine and/or ionizable, water soluble salts in such proportions that they would tend to cause separations of liquid detergents containing as a soil release promoting agent a copolymer of the present invented compositions and/or destabilize the soil release promoting polymer on storage, making it less effective for promoting soil release.

In liquid detergents enzymes tend to lose activity on storage unless stabilized, as by salts, e.g., sodium formate, glycols, e.g., propylene glycol, or other such materials. However the mentioned salts tend to destabilize quaternary ammonium halide fabric softeners and the copolymer soil release promoting agents which are desirable components of the present liquid detergents, and such destabilization of the soil release agent is especially bad in the presence of lower alkanolamines or salts thereof, such as triethanolamine (TEA), the presence of which will be avoided. Therefore it was surprising that the present liquid detergents could be made in clear and stable non-separating form, with the various functional components thereof being effective after storage at elevated temperatures.

In accordance with the present invention a stable fabric softening, soil release promoting, enzyme-containing liquid detergent comprises a detersive proportion of a nonionic detergent, a soil release promoting proportion of a soil release promoting polymer of polyethylene terephthalate and polyoxyethylene terephthalate, a softening proportion of a quaternary ammonium halide fabric softener, a proportion of enzyme sufficient to enzymatically hydrolyze proteinaceous and/or amylaceous soils, on fabrics during washing thereof with an aqueous washing solution of the liquid detergent, a stabilizing proportion of a stabilizer for the enzyme(s), and an aqueous medium, in which the pH is in the range of about 6 to 9 and in which there is present no more than 2% of water soluble ionizable material, such as salts and/or triethanolamine.

Although various synthetic organic nonionic detergents of satisfactory physical characteristics may be utilized, including condensation products of ethylene oxide and propylene oxide with each other and with hydroxyl-containing bases, such as nonyl phenol and Oxo-type alcohols, for best results it is highly preferred that the nonionic detergent be a condensation product of ethylene oxide and higher fatty alcohol. In such products the higher fatty alcohol is of 10 to 20 carbon atoms, preferably 12 to 15 or 16 carbon atoms, and the nonionic detergent contains from 2 or 3 to 20 or 30 ethylene oxide groups per mole, preferably from 6 to 11 or 12. Most preferably, the nonionic detergent will be one in which the higher fatty alcohol is of about 12 to 15 or 12 to 14 carbon atoms and which contains from 6 or 7 to 11 moles of ethylene oxide, e.g., 6.5. Among such detergents are Alfonic® 1214–60 C, sold by the Conoco Division of E. I. DuPont de Nemours & Co., Inc., and Neodols® 23–6.5 and 25–7, available from Shell Chemical Company. Among their especially attractive properties, in addition to good detergency with respect to oily and greasy soil deposits on goods to be washed, and excellent compatibility with the present polymeric release agents, fabric softeners and enzymes, are compatibilities with the various other components of the present liquid detergent compositions and long term viscosity stability in aqueous and aqueous alcoholic solutions.

The soil release promoting polymer, which is an essential component of the compositions of this invention, is a polymer of polyethylene terephthalate and polyoxyethylene terephthalate which is soluble (preferred) or dispersible in water and is depositable from wash water containing the detergent(s) onto synthetic organic polymeric fibrous materials, especially polyesters and polyester blends, so as to impart soil release properties to them, while maintaining them comfortable to a wearer of clothing made from such materials, and not preventing or significantly inhibiting vapor transmission through such clothing. Such polyesters have also been found to possess anti-redeposition properties and often assist in removing stains from substrates. They tend to maintain soil, especially oily or greasy soil, dispersed in wash water during washing and rinsing, so that it is not redeposited on the laundry. Useful such products are copolymers of ethylene glycol or other suitable source of ethylene oxide moiety, polyoxyethylene glycol and terephthalic acid or suitable source of the terephthalate moiety. The copolymers may also be considered to be condensation products of polyethylene terephthalate, which may sometimes be referred to as an ethylene terephthalate polymer, and polyoxyethylene terephthalate. While the terephthalic moiety is preferred as the sole dibasic acid moiety in the polymer, it is within the invention to utilize a relatively small proportion of isophthalic acid and/or orthophthalic acid (and sometimes other dibasic acids, too) to modify the properties of the polymer. However, the proportions of such acids or sources of such supplemental moieties charged to any reaction mix, and the corresponding proportions in the final polymer, will normally be less than 10% each of the total phthalic moieties present, and preferably will be less than 5% thereof.

The molecular weight of the polymer will be in the range of about 15,000 to 50,000, preferably being about 19,000 to 43,000, more preferably being about 19,000 to 25,000, e.g., about 22,000. Such molecular weights are weight average molecular weights, as distinguished from number average molecular weights, which, in the case of the present polymers, are often lower. In the polymers utilized the polyoxyethylene will be of a molecular weight in the range of about 1,000 to 10,000, preferably about 2,500 to 5,000, more preferably 3,000 to 4,000, e.g., about 3,400. In such polymers the molar ratio of polyethylene terephthalate to polyoxyethylene terephthalate units (considering

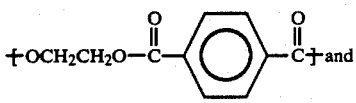

and

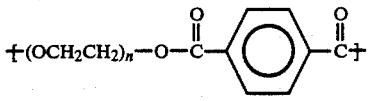

as such units) will be within the range of 2:1 to 6:1, preferably 5:2 to 5:1, even more preferably 3:1 to 4:1, e.g., about 3:1. The proportion of ethylene oxide to phthalic moiety in the polymer will be at least 10:1 and often will be 20:1 or more, preferably being within the range of 20:1 to 30:1 and more preferably being about 22:1. Thus, it is seen that the polymer may be considered as being essentially a modified ethylene oxide polymer, with the phthalic moiety being only a minor component thereof, whether calculated on a molar or weight basis. It is considered surprising that, with such a small proportion of ethylene terephthalate or polyethylene terephthalate in the polymer, the polymer is sufficiently similar to the polymer of the polyester fiber substrate (or other polymers to which it may be adherent, such as polyamides) that it is retained thereon during the washing, rinsing and drying operations. Yet, as shown by comparative experiments and various washing tests in which soil release is measured, the described polymer, in the present detergent compositions, deposits on washed synthetics, especially polyesters, from the wash water, so as to make the synthetics better able to be washed free of oily soil by the liquid nonionic detergent composition or other detergent product. It is considered that the polymer's increased hydrophilicity, attributable to the large proportion of hydrophilic ethylene oxide moieties therein, may be responsibe for the excellent soil release properties (for releasing lipophilic soils) which it imparts to the materials upon which it is deposited. Such hydrophilicity may also help the polymer to coact with the liquid nonionic detergent product components and may help to stabilize the polymer in the presence of the other liquid detergent components of this invention.

Various literature articles, texts and patents disclose methods for the manufacture of the present polymers, included among which are: Journal of Polymer Science, Vol. 3 pages 609–630 (1948); *Journal of Polymer Science*, Vol. 8, pages 1–22 (1951); *Fibers From Synthetic Polymers*, by Hill, published by Elsevier Publishing Company, New York, New York (1953), at pages 320–322; British Pat. Nos. 1,088,984 and 1,119,367; and U.S. Pat. Nos. 3,557,039; 3,893,929; and 3,959,230. Although suitable methods for making the instant polymers are described in such references it is considered that none of them discloses the particular polymers which are utilized in the present invention (but such are available commercially) and none of them discloses the present detergent compositions. Such polymers may be considered as having been randomly constructed from polyethylene terephthalate and polyoxyethylene terephthalate moieties, such as may be obtained by reacting polyethylene terephthalate (e.g.. spinning grade) and polyoxyethylene terephthalate, or reacting the ethylene glycol, polyoxyethylene glycol and acid (or methyl ester) precursors thereof. Yet, it is also within the invention to utilize more ordered copolymers, such as those made by reacting components of predetermined or known chain lengths or molecular weights, so as to produce what might be referred to as block copolymers or non-random copolymers. Graft polymers may also be practicable.

The described materials are available from various sources, the products of one of which will be described in more detail here. Useful copolymers for the manufacture of the detergent compositions of this invention are marketed by Alkaril Chemicals, Inc., and commercial products of such company that have been successfully employed to produce satisfactory soil release promoting detergent compositions are those sold by them under the trademarks Alkaril QCJ and Alkaril QCF, formerly Quaker QCJ and Quaker QCF. Such are described in the two page Quaker Chemical Corporation Technical Data Sheet entitled Quaker QCF. Products available from Alkaril Chemicals, Inc. in limited quantities, designated by them as 2056–34B and 2056–41, have also been found to be acceptable. The QCJ product, normally supplied as an aqueous dispersion, of about 15% concentration in water, and preferably used to make the present liquid detergents, is also available as an essentially dry solid (QCF). In both such types of products the molar ratio of ethylene oxide to phthalic moiety is about 22:1. In a 15% dispersion in water, as QCJ, the viscosity at 100° C., is about 96 centistokes. The 2056–41 polymer is like a hard, light brown wax and in it the hydrophile:hydrophobe ratio is about 16 to 1, with the viscosity being about 265 centistokes. The 2056–34B polymer appears to be a hard brown wax, with a hydrophile:hydrophobe ratio of about 10.9:1, and its viscosity, under the same conditions as previously mentioned, is about 255 centistokes. The higher the molecular weight of the polymer the lower the hydrophile:hydrophobe molar ratio may be therein and still result in satisfactory soil release promoting by the invented detergent compositions. The QCJ and QCF polymers have melting points (by differential thermal analysis) of about 50 to 60° C., a carboxyl analysis of 5 to 20 equivalents/$10^6$ grams and a pH of 6 to 8 in distilled water at 5% concentration. The molecular weights (weight average) are in the range of 20,000 to 25,000 and the ethylene terephthalate:polyoxyethylene terephthalate units molar ratio is about 74:26. All three of the mentioned trademarked products are water soluble in warm or hot water (at 40 to 70° C.) or at least are readily dispersible, and may be characterized as of high molecular weight, over 15,000, generally in the range of 19,000 to 43,000, often preferably 20,000 to 25,000, e.g., about 22,000.

The quaternary ammonium halide fabric softener may be any suitable such material which is stable in the present compositions. In some instances, known imidazolinium halides of satisfactory stability may be used instead of the quaternary ammonium halides. However, the quaternary ammonium halides are preferred. Such compounds will preferably be chlorides, although bromides and iodides may be useful. Of the four substituents on the quaternary nitrogen at least one and preferably two, will be a long chain substituent such as a higher linear or fatty alkyl, and more preferably, two such substituents will be higher fatty alkyl. The chain length will usually be from 10 to 20 carbon atoms, preferably 12 to 18 carbon atoms, with chain lengths of 12 and 14 carbon atoms or mixtures thereof, coco (such as coco-alkyl, derived from coconut oil or equivalent feed stock) being most preferred. The other substituents on the nitrogen will be lower alkyl, usually of 1 to 3 carbon atoms, and of such the most preferred is methyl. Thus, although other quaternary ammonium halides can also be useful, at least when they constitute only some of the quaternarysoftener, that which is most preferred and of highest stability in the present liquid detergents is dicoco dimethyl ammonium chloride. Such product is available as a liquid comprising 75% active ingredient, 14% of isopropanol and 11% of water.

The enzymes employed include both proteolytic and amylolytic enzymes, such as the alkaline proteases (subtilisin) and alpha-amylase. Among preferred enzyme preparations that are useful are Alcalase 2.5L (2.5 Anson units/g.) and Termamyl 120L, both manufactured by Novo Industri, A/S. However, other suitable proteolytic and amylolytic enzyme preparations may be used, too. The mentioned compositions are in liquid form and contain 5% of active enzyme in combination with 65% of propylene glycol and 30% of water. In this specification proportions referred to are of the enzymes in the preparations, only the active part thereof.

The stabilizer or a mixture of stabilizers for the enzyme is most preferably sodium formate or includes such salt, but other water soluble formates, such as potassium formate, can also be employed and acetates may also be useful, as may be other equivalent salts or mixtures of such salts and alkali metal formate.

The aqueous medium employed includes water and preferably also includes a lower alkanol. The water is desirably deionized water but city water of a hardness content up to about 300 p.p.m., as calcium carbonate (the hardness is usually of mixed magnesium and calcium ions), may be employed, although it is preferable for the hardness content to be less than 100 p.p.m. to help to avoid any destabilization of the liquid detergent or separations of any components thereof. Instead of deionized water some water may be from the starting materials, such as aqueous soil release promoters, enzyme preparations, softeners, alkanols, and dyes. The lower alkanol may be any of ethanol, isopropanol or n-propanol,but ethanol is much preferred. When ethanol is employed it will normally be as a denatured alcohol, such as 3A, which includes a small proportion of water plus denaturant. Small amounts of compatible dissolved salts may also be present in the aqueous medium but normally such will be avoided to the extent feasible.

Another liquid that may desirably be employed in the present liquid detergents is a lower glycol, such as one of 3 to 6 carbon atoms in the alkyl group thereof. While hexylene glycol may be utilized in some formulations, in some others it can promote instability, so propylene glycol is preferred.

Various suitable adjuvants may be present in the invented liquid detergents, such as fluorescent dyes, colorants (dyes and water dispersible pigments, such as ultramarine blue), bactericides, fungicides and perfumes. Concentrations of such components will usually be kept low, often less than 1% and preferably less than 0.7%. Thus, the perfume concentration will be less than 1%, preferably 0.2 to 0.6%, e.g., 0.4%. The fluorescent brightener will preferably be a stilbene brightener and the content thereof will be from 0.05 to 0.25%, preferably 0.05 to 0.15%, e.g., 0.1%. Colorants, such as Polar Brilliant Blue, will be from 0.001 to 0.03%, preferably 0.002 to 0.02%, e.g., 0.0025% or 0.01%. The various adjuvant materials will be chosen for a compatibility with the other formula components and for non-separating and non-settling characteristics. Because water soluble ionizable salts, whether inorganic or organic, are generally incompatible with soil release promoting agents, their presence will usually be avoided. Among such salts desirably avoided are sodium sulfate, potassium sulfate, sodium chloride, potassium chloride, ammonium chloride and ammonium sulfate, but these are only examples of such salts. While sodium formate should also be omitted from many liquid detergents, surprisingly, a limited proportion thereof has been found to be compatible with the other components of the present formulation, in combination. The presences of ionizable species, such as triethanolamine (TEA), diethanolamine, ethanolamine, diisopropanolamine, n-propanolamine and of the lower mono-, di-, tri- and mixed lower alkanolamines of 2 to 4 carbon atoms per alkanol moiety will be avoided because, like the mentioned salts, they destabilize the soil release promoting polymer and/or the liquid detergent. Of these,TEA appears to be the most destabilizing. In this specification such ionizable species, which may form salts, should be counted as parts of the permissible proportions of the salts that may be present. Generally it will be desirable to avoid the presences of other adjuvants than colorants, perfumes, fluorescent brighteners, antioxidants and any neutralizing agents that may be employed to adjust the pH of the liquid detergent to the stable range. It is preferred that the neutralizing agent which may be employed, usually to increase the pH of the liquid detergent mixture, should be alkali metal hydroxide, such as sodium hydroxide, in aqueous solution at a concentration of from 5 to 40%, e.g., 15 to 25%. Especially to be avoided are triethanolamine salts and free triethanolamine.

The liquid detergent made will be of a desirable viscosity, often in the range of 50 to 500 centipoises, preferably 100 to 200 centipoises, and the viscosity may be adjusted by modifying the proportion of lower alkanol, within the range given. The liquid detergent will be readily pourable but will possess a desired "body". The pH thereof will be in the range of 6 to 9, preferably 6.1 to 7.9 and often more preferably 6.5 to 7.5.

In the invented soil release promoting liquid detergents of this invention which are of improved stability on storage, so that the soil release promoting polymer, softening agent and enzyme(s) do not deteriorate and do not separate from the rest of the composition, the proportions of the various components will be as are given below. The synthetic organic nonionic detergent (which includes mixtures thereof) content will be within the range of 10 to 35% of the product, preferably being 15 to 30% and more preferably 20 to 25%, e.g., 22%. The soil release promoting polymer content will be about 0.5 to 5%, preferably 0.7 to 2% and more preferably 0.8 to 1.5%, e.g., about 1%, (on an active ingredient basis). The content of quaternary compound will be 1 to 10%, preferably 3 to 8% and more preferably 3 to 6%, e.g., 4.5%. The enzyme content may be from 0.005 to 0.15%, preferably 0.025 to 0.05%, of which the protease content is 0.005 to 0.1% and the amylase content, if amylase is present, is 0.005 to 0.05%. Preferred contents of the enzymes are 0.01 to 0.05% and 0.01 to 0.025%, respectively. More preferably, 0.015 to 0.04% is the percentage of protease. Specific formula percentages are about 0.023 and 0.015%, respectively. The stabilizer for the enzymes, a lower aliphatic acid salt, such as sodium formate, will usually be from 0.2 to 2%, preferably 0.5 to 1.5%, and more preferably 0.7 to 1.3%, e.g., 1%. The lower alkanol content will be from 1 to 10%, preferably 1.5 to 3% and more preferably 2 to 2.5%, e.g., 2 or 2.2%. The lower glycol content is 2 to 10%, preferably 3 to 8%, more preferably 4 to 7%, e.g., 6%. The water content will be about 40 to 80%, preferably 50 to 70%, more preferably 60 to 65%, e.g., about 63%.

The contents of ionizable water soluble salts, whether organic or inorganic, should be kept low, usually being no more than 1% of the liquid detergent, preferably less than 0.5% and more preferably less than 0.3%, and the content of triethanolamine will similarly be limited to avoid separation of the soil release promoting polymer, with the desirable limits being 0.5%, preferably 0.2%, and most preferably 0%. In some instances the salt content will be held to limits lower than the allowed alkanolamine content because some salts can be even more detrimental to product stability than the alkanolamine However, in the present compositions the contents of water soluble alkali metal lower carboxylate, such as sodium formate, may be up to 2% because such components stabilize the enzymes, and at such concentrations, especially at about 1% or less, are compatible with the detergent product.

The invented liquid detergents may be made by mixing the various components thereof with the aqueous medium, preferably containing at least some of the lower alkanol, until they dissolve (or satisfactorily disperse) therein, or different components may be selectively dissolved in portions of the water and/or lower alkanol and/or lower glycol, and/or liquid soil release promoting polymer preparation, and/or liquid enzyme preparation, and then the various liquid fractions may be mixed together. It will often be preferable to adjust the pH of the liquid to within the range of 6.1 to 7.9, often more preferably 6.5 to 7.5, by addition of a suitable neutralizing agent (not triethanolamine) which will not have a destabilizing influence on the soil release promoting polymer, the enzyme(s), the softener, or the liquid product containing them, so that such will not deteriorate and will not separate from the liquid detergent on storage, especially at elevated temperature. The preferred neutralizing agent is an aqueous solution of sodium hydroxide, which will normally be between 10 and 40% sodium hydroxide, preferably 15 to 25%, although more dilute concentrations may sometimes be desirable. Subsequently, the viscosity of the product may be adjusted by means of alkanol and/or water addition.

The invented liquid detergent composition may be used to wash (and treat) laundry containing synthetic fibers, such as those of polyester, e.g., Dacron ®, in the normal manner used in washing with other liquid detergents. However, less of the present product may be employed because of the soil release promoting action thereof, and in many cases the cleaning and softening effects obtained will be superior. Different concentrations of the liquid detergent may be used, normally being from about 0.04 to 0.6%, preferably 0.1 to 0.3%. Generally, it will be advised to use about ½ cup (about 120 ml.) of the liquid detergent per standard wash load (about 17 U.S. gallons, for a top loading washing machine), which is a concentration of about 0.2% of the liquid detergent in the wash water. About the same concentration may be used when washing is in a front loading machine, although the water employed is less. Normally about 7 or 8 pounds (3 to 3.5 kg.), of laundry will be charged to the washing machine. The wash water will preferably be at least 120° F. (49° C.) but good washing and treatments, with the soil release promoting polymer, the enzymes and the softener in the liquid detergent, are obtainable at temperatures in the range of about 40° to 80° C., preferably 45° to 70° C. The dry weight of materials being washed and treated will usually be from about 5 to 15 or 20% of the weight of the aqueous washing medium, preferably about 5 to 10% thereof. The wash will be conducted with agitation over a period of about five minutes to one-half hour or one hour, often from 10 to 20 minutes. Then the washing materials will be rinsed, usually with several rinses, and will be dried, as in an automatic laundry dryer. Preferably, the first washing of the material to be treated will be when that material is not unduly dirty, so that the soil release promoting polymer will be deposited on as clean a surface as possible. However, this is not necessary, and improvements in the cleaning of subsequently soiled materials and swatches will be observed when no special effort is made to have the first washing be that of a cleaner substrate. Up to a limit, sometimes about 3 or 5 treatments, plural washings with the liquid detergent of this invention increase the soil releasing properties of the treated material, while maintaining it soft.

When polyester and polyester/cotton blend fabrics are washed in the manner described with the compositions of this invention, and are then soiled or spotted with dirty motor oil and washed with a detergent of this invention or another commercial detergent (often of the built type), significant removal of the lipophilic soil is noted, compared to similar treatments in which the liquid detergent employed initially did not contain any soil release promoting polymer. In other comparisons, when substantial proportions of water soluble ionizable salt, such as 5% of sodium sulfate, or more than 1% of triethanolamine or a salt thereof, are present in the liquid detergent it is found that after storage at elevated temperature (43° C.) for two weeks, simulating a lengthier storage at room temperature, phases separate from the liquid detergent body and the soil release promoting properties of the polymer contained therein are diminished, as are the enzymatic and softening activities. When the enzyme stabilizer is omitted enzymatic action is decreased substantially on storage. Thus, the compositions of this invention are important because they are stable, resulting in a more effective product for the purposes intended, soil release improvement, cleaning effects and softening of the fabrics laundered, and also resulting in a more attractive liquid detergent composition, which does not separate on storage.

The following examples illustrate the invention but do not limit it. Unless otherwise indicated, all parts are by weight and all temperatures are in ° C.

EXAMPLE 1

| Component | Percent |
|---|---|
| Neodol 25-7[1] | 22.0 |
| Alkaril QCJ[2] soil release promoting polymer | 6.7 |
| Adogen 462[3] | 6.0 |
| Propylene glycol | 5.0 |
| Denatured ethanol (3A) | 2.2 |
| Sodium formate | 1.0 |
| Alcalase 2.5 L[4] | 0.45 |
| Termamyl 120 L[5] | 0.3 |
| Dye (Polar Brilliant Blue) | 0.0025 |
| Perfume | 0.4 |
| Deionized water | q.s. |
| | 100.00 |

[1]Condensation product of approximately 7 moles of ethylene oxide and a higher fatty alcohol averaging 12 to 15 carbon atoms per mole

[2]A 15% solution or dispersion in water of a copolymer of polyethylene terephthalate and polyoxyethylene terephthalate of a molecular weight of about 22,000 wherein the polyoxyethylene is of a molecular weight of about 3,400, the molar ratio of polyethylene terephthalate to polyoxyethylene terephthalate units is about 3:1 and the proportion of ethylene oxide to phthalic moiety in the polymer is about 22:1, sold by Alkaril Chemicals, Inc.

[3]Di-coco dimethyl ammonium chloride, sold by Sherex Industries (contains 75% active ingredient, 14% isopropanol and 11% water)

[4]Proteolytic enzyme, sold by Novo Industri, A/S (5% enzyme active ingredient, 65% propylene glycol and 30% water)

[5]Amylolytic enzyme, sold by Novo Industri, A/S (5% enzyme A.I., 65% propylene glycol and 30% water)

The formula liquid detergent is made by mixing together a portion of the water with the nonionic detergent, followed by additions of the soil release promoting polymer, the ethanol, propylene glycol, fabric softener, enzymes, sodium formate (dissolved in some water), dye, and any remaining water. Then, an acid or base (NaOH is preferred) may be used, if desired, to adjust the pH to 6 within the desired range, e.g. 7. When the pH is lower than desired desired range e.g., 7. When the pH is lower than desired an aqueous solution of sodium hydroxide (20%) is used to raise it to the desired level. The proportion employed is small, e.g., about 0.2% or less NaOH. Next, the formula proportion of perfume is added. The product made is tested by being stored at 43.3° C. for a week, after which it is observed to be clear light blue liquid in a stable single phase, essentially like that when it was made. The protease activity is 70% of that when the liquid detergent was made and the amylase activity is 85% of its initial value.

Shortly after making the liquid detergent it is used to wash a test load of clean fabrics, including some of polyester materials and others of 65% polyester and 35% cotton material. The washing concentration is 0.1% by weight of the liquid detergent, on the basis of the weight of the wash water, and the swatches washed are about 5% by weight of the wash water. After washing in a standard test washing machine, using standard conditions previously described in this specification, is completed, the swatches are rinsed and dried. Subsequently each test swatch is stained with about three drops of dirty motor oil of a standard type used for such testing and is washed in the same type of machine, using a commercial detergent. As controls, swatches that were not previously treated with the present liquid detergent are employed. The washing-treating and subsequent washing temperatures are the same in all cases, being 49° C., which is considered to be an optimum temperature for treatment. In some experiments, the subsequent washing is with the invented liquid detergent composition. In all such instances the treated swatches are significantly whiter to the eye and by reflectometer testing than the control swatches, showing that the soil release promoting component of the liquid detergent composition effectively aided in the removal of such applied soil from the swatches during the subsequent washings. Also, it is noted that the redeposition onto unsoiled portions of the fabrics of the dirty motor oil removed (from the spotting application) is diminished when soil release polymer is applied to the fabric before test soiling thereof. Thus, the present liquid detergent containing soil release promoting polymer, in addition to aiding removal of the soi, also helps to maintain it suspended, inhibiting deposition of such removed soil on other parts of the test material. This desirable activity is obtained despite the presence in the liquid of the sodium formate and any other salt(s)

When 2% or 3% of triethanolamine or TEA salt is present in the liquid detergent of the formula previously given, in replacement of part of the water thereof, after two weeks of storage at 43.3° C. the detergent is found to have separated. Separation also occurs under such conditions when the triethanolamine is absent and 5% of sodium sulfate is present in the formula. Also, when the triethanolamine is present, the soil release promoting action of the liquid detergent is significantly decreased, compared to the experimental formula of this invention,after a week of storage at elevated temperature (accelerated aging) at 43.3° C., followed by testing in the manner previously described. Furthermore, storage at room temperature also results in such diminution of soil release promoting activity of formulas containing the indicated proportions of triethanolamine and/or sodium sulfate, compared to the experimental formula.

When the amount of soil release promoting polymer is decreased to 0.8% or increased to 2% the same types of results reported above are obtained, except that the 2% polymer formulation is more effective than the 1% formula in promoting soil release according to the tests described, and the 0.8% formula is slightly less effective, although at both 0.8% and 2% concentrations good and excellent results, respectively, are obtained.

When various tests are made using other lipophilic soils, such as corn oil (red), butter, shoe polish, lipstick, French dressing and barbeque sauce, similar results are obtained. The same results are also obtained when the test fabrics are single knit Dacron, double knit Dacron and Dacron/cotton blends, and such are also obtained with treatment temperatures above 32° C. Such are also the results when, instead of the laboratory testing washing machine, a commercial or home laundry machine of either top loading or side loading type is employed.

Tests on the liquid detergent for fabric softening and enzymatic cleaning power are satisfactory, indicating that the quaternary ammonium halide and the proteolytic and amylolytic enzymes are functionally effective in the stable liquid detergent. This is so despite the fact that enzymes and quaternary ammonium halides are often unstable in liquid detergent systems, especially at elevated temperatures. However, replacement of propylene glycol with higher glycols, such as those of 8 to 12 carbon atoms, will result in separation of the product into two phases. In the particular formula given a complete replacement of propylene glycol with hexylene glycol will also cause phase separation although hexylene glycol and amylene glycol are considered to be useful glycol components of the present type of liquid detergent if employed in lesser proportions and if employed in conjunction with lower glycols, such as propylene glycol. Similarly, if the di-coco dimethyl ammonium chloride is replaced by di-hydrogenated tallow dimethyl ammonium chloride, the liquid detergent also separates into two phases, especially in the presence of the hexylene glycol (in replacement of propylene glycol). However, again, in some circumstances the di-hydrogenated tallow dimethyl ammonium chloride can be employed in a stable product, by decreasing the proportion thereof present and mixing it with di-coco dimethyl ammonium chloride or other di-higher alkyl di-lower alkyl quaternary ammonium halides wherein the higher alkyls are of 12 to 14 carbon atoms and the lower alkyls are of 1 or 2 carbon atoms. As an alternative, a more hydrophilic quaternary ammonium halide, such as ditallow dimethyl ammonium chloride, which possesses a greater degree of unsaturation and thus is more tolerant of electrolytes, may be successfully used.

EXAMPLE 2

When, in the primary formula of Example 1, the nonionic detergent is replaced by Neodol 23-6.5, 0.01% of Polar Brilliant Blue dye is used instead of 0.0025%, and a stilbene fluorescent brightener is present, e.g., Tinopal RBS-200, Tinopal 5BM or Tinopal 4226 (all sold by CIBA-Geigy), or Phorwite RKH or Phorwite BBP (sold by Mobay Chemical Co.) to the extent of 0.1%,a stable and effective product which functions like that of Example 1 results but it has a greater whitening power due to the presence of the brightener, which is stable in the product. The product of this example is also of attractive clear appearance and is stable on storage.

EXAMPLE 3

The contents of the various experimental formulas of this invention given in Examples 1 and 2 are varied ±10% and ±25%, while keeping the proportions of the various materials within the ranges recited in the specification. In such formulations instead of employing the QCJ soil release polymer (aqueous solution), 1% of QCF (Alkaril Chemicals CAS 9016-88-0) and 5.7% of water are substituted, with the QCF first being dissolved in the water. Also other enzymes, stabilizers, fabric softeners, glycols, alcohols and colorants, as described in the specification, may be employed within the proportion ranges given. The detergents resulting are clear, stable and non-separating and possess good soil release promoting, softening, cleaning and brightening properties, like those described in Examples 1 and 2. Such is also the case when the fluorescent dye, colorant and perfume are omitted from the formulas of this example. Similarly, when triethanolamine or ionizable salt is present in such formulas beyond the limits given, the product becomes less stable and less effective in promoting soil release during washing, and when the sodium formate and glycol are omitted the effects of the enzyme are lost after only a few days storage at the elevated testing temperature.

In other variations in this example the nonionic detergent is a mixture of equal parts of Neodol 23-6.5 and Neodol 25-7, with the same total proportion being employed Results like those previously reported in Examples 1 and 2 are obtainable in both test washing machines and household and commercial washing machines, which are either top loading or side loading. Such is also the situation when pH adjustments are made with potassium hydroxide and when such adjustments, made with sodium hydroxide or potassium hydroxide, are to pH's of 6.6, 7.4, 7.9, and 8.6. Normally such pH adjustments will utilize less than 1% of sodium hydroxide solution, preferably less than 0.5% thereof and more preferably less than 0.2% thereof. In some instances the sodium hydroxide may be added as a formula constituent, in said proportion as is known to give the desired pH control (based on past experience with the formula) but it will still be preferred for it to be added before the perfume, although such is not necessary. Similarly, while a 20% sodium hydroxide solution concentration may often be preferable, other concentrations thereof may be employed too.

From the working examples and the preceding description it is seen that the present invention is of a stable and attractive liquid detergent which contains various components that might have been expected to interfere with the stability of the final product. Yet, surprisingly, a stable product is obtainable in accordance with the invention. Such product has desirable soil release promoting, fabric softening, soil decomposing and detergent properties. Several of the components of the invented compositions exert dual effects therein. For example, the propylene glycol may help to solubilize lipophilic materials in the formulation while at the same time helping to stabilize the enzymes. The sodium formate, which is a stabilizer for enzymes, does not destabilize the soil release agent, as would have been expected. Although some quaternary ammonium halides and some glycols can destabilize liquid detergent formulas like those of this invention, the present materials do not do so. This is surprising because hydrophobic quaternary ammonium halides, which are normally flocculated from solution by electrolytes, are stable in the invented liquid detergents. Thus, it is seen that the present compositions represent an unpredictable advance in the art of making stable products which are preferably attractively clear (transparent or translucent), although in some instances opalescent and semi-clear or intentionally creamy products may be made.

The invention has been described with respect to various illustrations and preferred embodiments thereof but is not to be limited to these because one of skill in the art, with the present specification before him, will be able to utilize substitutes and equivalents without departing from the invention.

What is claimed is:

1. A stable fabric softening, soil release promoting, enzyme-containing liquid detergent comprising a detersive proportion, within the range of 10 to 35%, of a nonionic detergent, a soil release promoting proportion, within the range of 0.5 to 5%, of a soil release promoting polymer of polyethylene terephthalate and polyoxyethylene terephthalate which is of a molecular weight in the range of 15,000 to 50,000, wherein the polyoxyethylene of the polyoxyethylene terephthalate is of a molecular weight in the range of 1,000 to 10,000, with the molar ratio of ethylene terephthalate to polyoxyethylene terphthalate units being within the range of 2:1 to 6:1, a softening proportion, within the range of 1 to 10%, of a di-higher alkyl dimethyl ammonium halide, a proportion of enzyme, within the range of 0.005 to 0.1%, which includes proteolytic enzyme, and which is sufficient to enzymatically hydrolyze proteinaceous soils on fabrics during washing thereof with an aqueous washing solution of the liquid detergent, a stabilizing proportion, within the range of 0.2 to 2%, of a stabilizer for the enzyme, and an aqueous medium, in which the pH is in the range of 6 to 9 and in which there is present no more than 2% of water soluble ionizable material.

2. A liquid detergent according to claim 1 which comprises from 15 to 30% of nonionic detergent, which is a condensation product of higher fatty alcohol of 10 to 20 carbon atoms and 3 to 20 moles of ethylene oxide per mole of higher fatty alcohol, 3 to 8% of quaternary ammonium halide, which is a chloride and in which the higher alkyls are of 12 to 18 carbon atoms, 0.005 to 0.05% of proteolytic enzyme, 0.005 to 0.05% of amylolytic enzyme, 0.5 to 1.5% of a stabilizer for the enzymes and from 1 to 10% of a lower alkanol.

* * * * *